US006550206B2

(12) United States Patent
Lee

(10) Patent No.: US 6,550,206 B2
(45) Date of Patent: Apr. 22, 2003

(54) WOOD FLOOR ASSEMBLY

(76) Inventor: Chiu-Ying Lee, No. 29, Alley 51, Lane 851, Chung-Shan Rd., Shen-Kang Hsiang, Taichung Hsien (TW)

( * ) Notice: Subject to any disclaimer, the term of this patent is extended or adjusted under 35 U.S.C. 154(b) by 0 days.

(21) Appl. No.: 09/904,052

(22) Filed: Jul. 12, 2001

(65) Prior Publication Data

US 2003/0009973 A1 Jan. 16, 2003

(51) Int. Cl.[7] ..... E04B 5/00
(52) U.S. Cl. ..... 52/480; 52/403.1
(58) Field of Search ..... 52/480, 403.1, 52/590.1, 592.4, 592.1, 794.1, 211, 212

(56) References Cited

U.S. PATENT DOCUMENTS 1,946,646 A * 2/1934 Storm ..... 20/7
2,123,409 A * 7/1938 Elmendorf ..... 52/387
3,387,422 A * 6/1968 Wanzer ..... 52/387
3,553,919 A * 1/1971 Omholt ..... 52/480
3,579,941 A * 5/1971 Tibbals ..... 52/384
3,786,608 A * 1/1974 Boettcher ..... 52/480
4,170,859 A * 10/1979 Counihan ..... 52/391
4,819,932 A * 4/1989 Trotter, Jr. ..... 472/92
4,910,936 A * 3/1990 Abendroth et al. ..... 52/403.1
5,295,341 A * 3/1994 Kajiwara ..... 404/41
5,671,575 A * 9/1997 Wu ..... 52/403.1
5,727,354 A * 3/1998 Clement ..... 52/387
5,768,850 A * 6/1998 Chen ..... 403/386
6,134,854 A * 10/2000 Stanchfield ..... 52/403.1
6,332,733 B1 * 12/2001 Hamberger et al. ..... 403/274

* cited by examiner

*Primary Examiner*—Jeanette Chapman
(74) *Attorney, Agent, or Firm*—Connolly Bove Lodge & Hutz

(57) ABSTRACT

A wood floor assembly includes wood floors, joint bases, soft pads, and U-shaped clips. The wood floor has a first elongated side protruded with an insertion flange, and a second elongated side recessed with an insertion groove. The insertion flange has a bottom edge recessed with a first insertion snap groove, and the insertion groove has a bottom edge recessed with a second insertion snap groove. The joint base has a first side protruded with an insertion block and a second side recessed with an insertion recess. The joint base has a top face protruded with a first locking plate and a second locking plate. The first locking plate is formed with a first locking hook portion and a second locking hook portion. The U-shaped clip is clamped and positioned two adjacent joint bases.

4 Claims, 4 Drawing Sheets

WOOD FLOOR ASSEMBLY

BACKGROUND OF THE INVENTION

1. Field of the Invention

The present invention relates to a wood floor assembly, and more particularly to a wood floor assembly that may be assembled and dismantled quickly and easily.

2. Description of the Related Art

A conventional wood floor assembly in accordance with the prior art comprises multiple base plates secured on the ground, and multiple wood floors bonded on the base plates by glue, adhesive or the like. However, the base plates combined with each other by nails, and the wood floors are bonded on the base plates by glue, adhesive or the like, so that the conventional wood floor assembly cannot be assembled quickly and easily, thereby wasting time and manual energy, and thereby increasing the cost of work. In addition, the joint structure between the wood floors is subjected to the action of a heat expansion or cold contraction, so that the wood floors are easily deformed or distorted during long-term utilization, thereby adversely affecting the function of the conventional wood floor assembly, and thereby decreasing the lifetime of the conventional wood floor assembly.

SUMMARY OF THE INVENTION

The primary objective of the present invention is to provide a wood floor assembly that may be assembled and dismantled quickly and easily, without having to provide nails, adhesive, glue or the like, thereby facilitating the user assembling and dismantling the wood floor assembly, and thereby enhancing the versatility of the wood floor assembly.

In accordance with the present invention, there is provided a wood floor assembly, comprising wood floors, joint bases, soft pads, and U-shaped clips, wherein,

- the wood floor has a first elongated side protruded with an insertion flange, and a second elongated side recessed with an insertion groove, the insertion flange has a bottom edge recessed with a first insertion snap groove, the insertion groove has a bottom edge recessed with a second insertion snap groove, the wood floor has a bottom face defining a securing groove;
- the joint base is a hollow joint base made of plastic material, and has a first side protruded with an insertion block and a second side recessed with an insertion recess, the joint base has a top face having a central position that is protruded with a first locking plate and a second locking plate, the first locking plate of the joint base has a top edge having two sides extended with a first locking hook portion and a second locking hook portion;
- the soft pad is a soft foamed pad that is bonded on a bottom face of the joint base; and
- the U-shaped clip is a metallic elastic snap clip structure, and may be clamped and positioned in the hollow joint bases of two adjacent joint bases.

Further benefits and advantages of the present invention will become apparent after a careful reading of the detailed description with appropriate reference to the accompanying drawings.

DETAILED DESCRIPTION OF THE INVENTION

Figure 1:
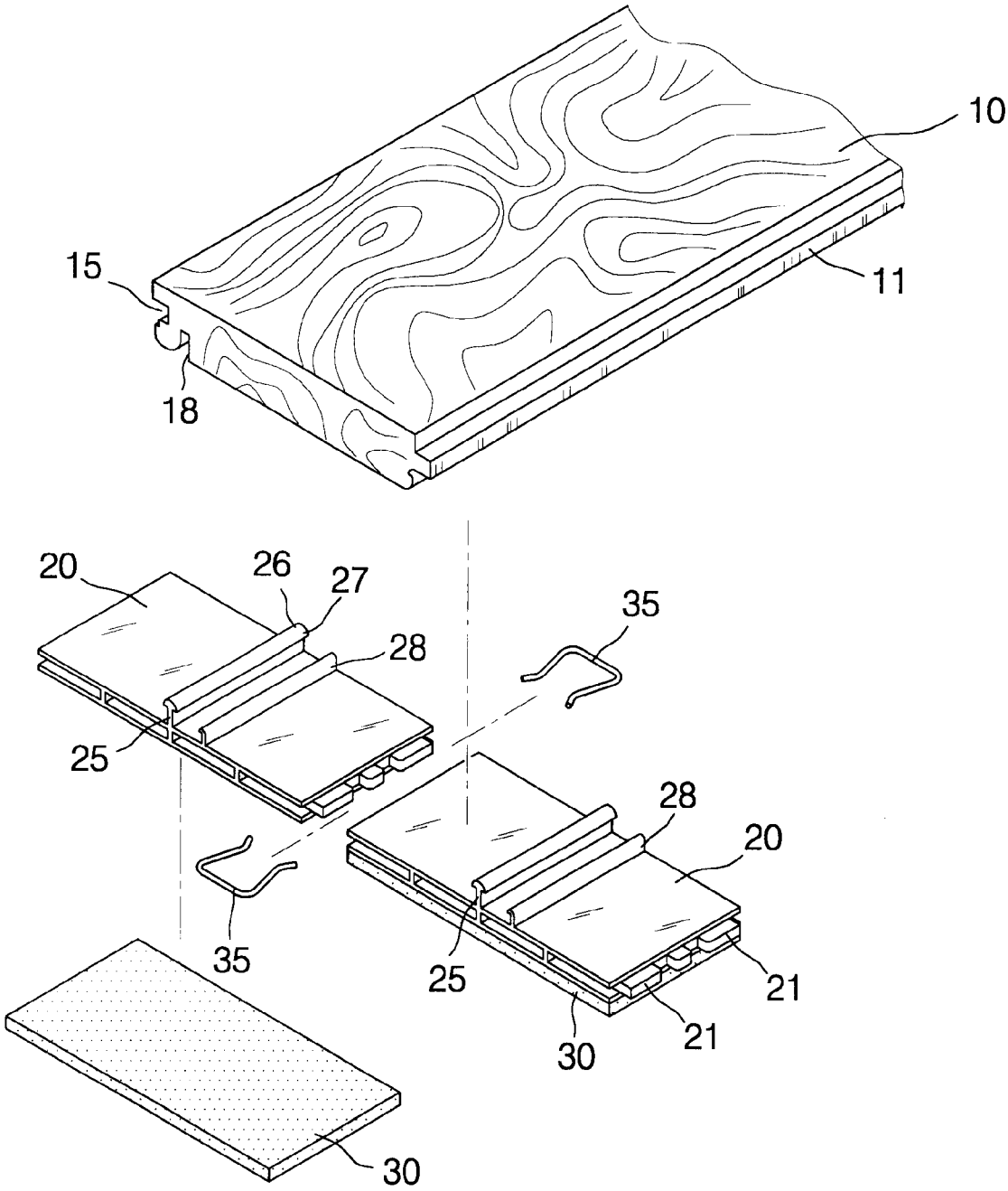
FIG. 1 is an exploded perspective view of a wood floor assembly in accordance with the present invention.
Figure 2:
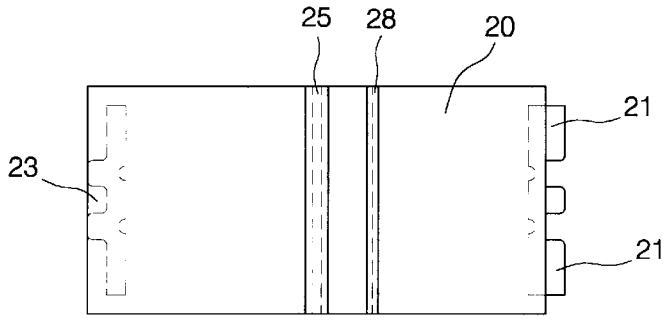
FIG. 2 is a plan view of a joint base of the wood floor assembly in accordance with the present invention.
Figure 3:
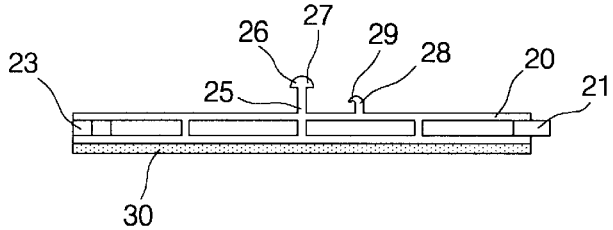
FIG. 3 is a side plan view of the joint base of the wood floor assembly as shown in FIG. 2.

Referring to the drawings, a wood floor assembly in accordance with the present invention comprises wood floors 10, joint bases 20, soft pads 30, and U-shaped clips 35.

The wood floor 10 is a substantially rectangular plate made of wood material, and has a first elongated side having a central portion protruded with an insertion flange 11, and a second elongated side having a central portion recessed with an insertion groove 15, so that any two adjacent wood floors 10 may be correspondingly combined with each other integrally. The insertion flange 11 has a bottom edge recessed with a first insertion snap groove 12. The insertion groove 15 has a bottom edge recessed with a second insertion snap groove 16. The wood floor 10 has a bottom face defining a securing groove 18 formed at a proper position thereof.

Figure 8:
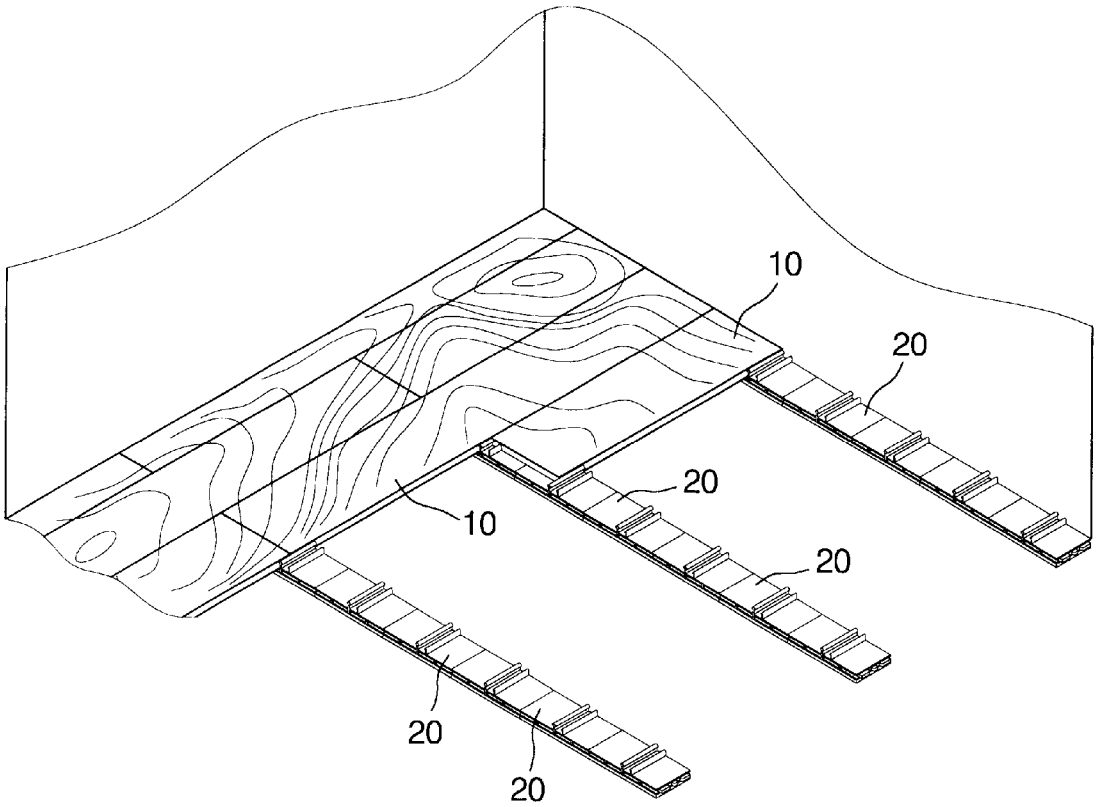
FIG. 8 is a perspective view showing that the wood floors are combined with the joint bases.

The joint base 20 is a hollow joint base made of plastic material, and has a first side protruded with an insertion block 21 and a second side recessed with an insertion recess 23, so that any two adjacent joint bases 20 may be assembled and combined into an elongated rail-shaped floor fixing structure as shown in FIG. 8. Thus, a close insertion snap structure is formed between any two adjacent joint bases 20, so that the two adjacent joint bases 20 will not displace or slide relative to each other, thereby preventing occurrence of detachment.

Figure 7:
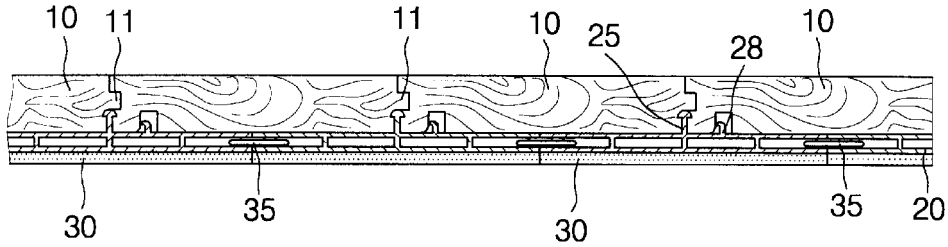
FIG. 7 is a schematic operational side plan view of the wood floor assembly as shown in FIG. 1 after assembly.

The joint base 20 has a top face having a central position that is protruded with a first locking plate 25 and a second locking plate 28. The first locking plate 25 of the joint base 20 has a top edge having two sides extended with a first locking hook portion 26 and a second locking hook portion 27. The first locking hook portion 26 is snapped on the first insertion snap groove 12 of the wood floor 10, while the second locking hook portion 27 is snapped on the second insertion snap groove 16 of another wood floor 10. The second locking plate 28 of the joint base 20 has a top edge extended with a locking hook portion 29 that is inserted and secured in the securing groove 18 of another wood floor 10, so that if another wood floor 10 is mounted on a side wall and the width thereof needs to cut, the wood floor 10 after being cut can still be inserted and closely secured between the first locking plate 25 and the second locking plate 28 on the top face of the joint base 20 as shown in FIG. 7. Thus, the side material of the wood floor 10 after being cut needs not to be bonded with glue or adhesive.

The soft pad 30 is a soft foamed pad that is bonded on the bottom face of the joint base 20, thereby providing the shock-absorbing, anti-skid and noise damping effects.

Figure 4:
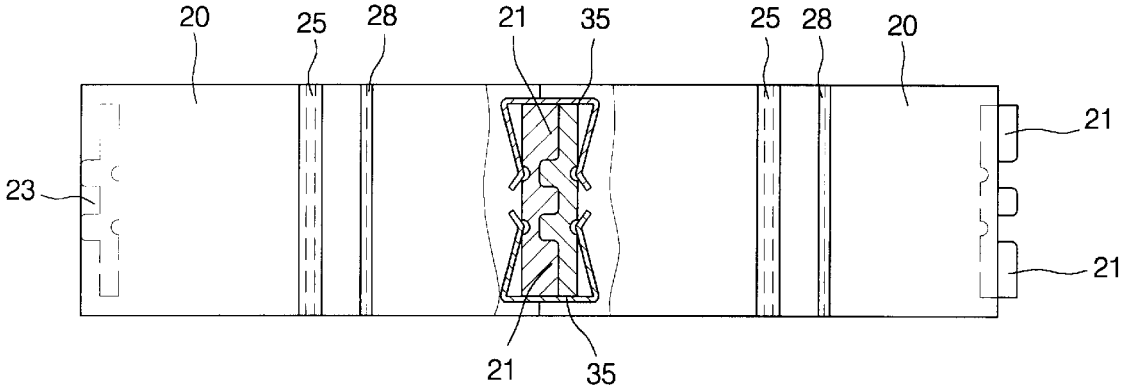
FIG. 4 is a plan assembly view of the wood floor assembly as shown in FIG. 1.
Figure 5:
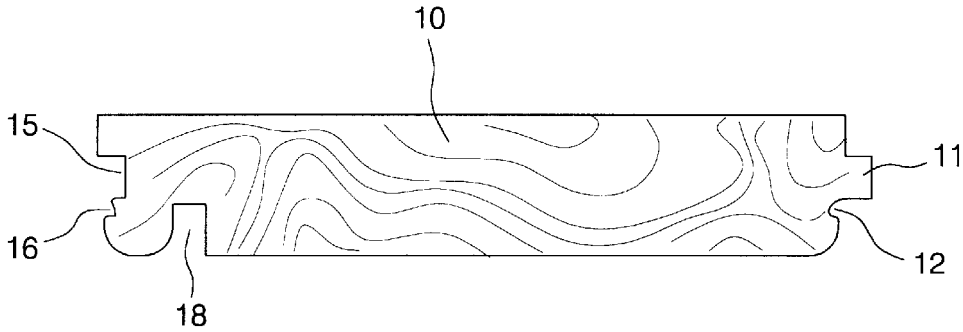
FIG. 5 is a side plan view of a wood floor of the wood floor assembly in accordance with the present invention.
Figure 6:
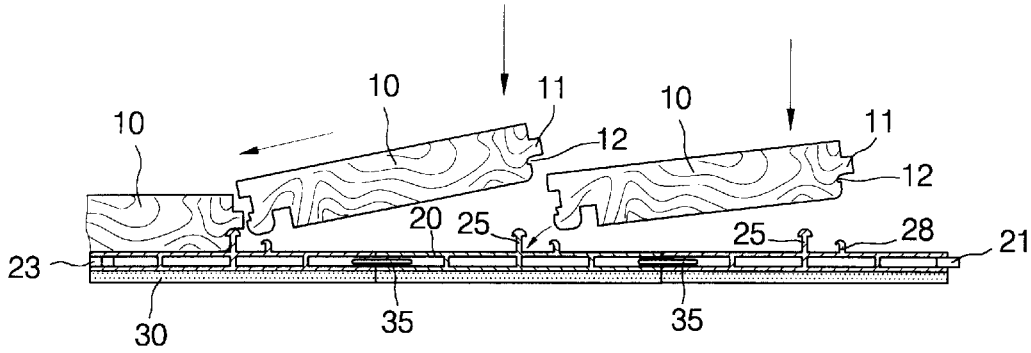
FIG. 6 is a schematic operational side plan view of the wood floor assembly as shown in FIG. 1 before assembly.

The U-shaped clip 35 is a metallic elastic snap clip structure, and may be clamped and positioned in the hollow bases of two adjacent joint bases 20 as shown in FIGS. 4, 6 and 7, so that an elastic snap action is formed between the joint bases 20, so that the joint bases 20 may be assembled and dismantled quickly and easily.

The multiple joint bases 20 are combined with each other by the U-shaped clips 35, thereby forming multiple elongated rail-shaped floor fixing structures as shown in FIG. 8. The multiple wood floors 10 are then inserted and secured on the top faces of the joint bases 20 respectively.

In assembly, each joint base 20 is bonded with a soft pad 30. Then, the multiple joint bases 20 are inserted and fitted with each other, and may be integrally combined with each other by the U-shaped clips 35, thereby forming multiple elongated rail-shaped floor fixing structures as shown in FIG. 8. Thus, a close insertion snap structure is formed between any two adjacent joint bases 20, so that the two adjacent joint bases 20 will not displace or slide relative to each other, thereby preventing occurrence of detachment. Subsequently, the multiple wood floors 10 are serially inserted and snapped on the top faces of the joint bases 20 respectively, whereby the first locking hook portion 26 of the first locking plate 25 of the joint base 20 is snapped on the first insertion snap groove 12 of the wood floor 10, and the second locking hook portion 27 of the first locking plate 25 of the joint base 20 is snapped on the second insertion snap groove 16 of another wood floor 10, while the locking hook portion 29 of the second locking plate 28 of the joint base 20 is inserted and secured in the securing groove 18 of another wood floor 10, thereby forming the wood floor assembly in accordance with the present invention as shown in FIG. 7.

Accordingly, in accordance with the present invention, the wood floor assembly may be assembled and dismantled quickly and easily, without having to provide nails, adhesive, glue or the like, thereby facilitating the user assembling and dismantling the wood floor assembly, and thereby enhancing the versatility of the wood floor assembly. In addition, the wood floors and the joint bases of the wood floor assembly are combined in a snapping insertion manner, thereby preventing the wood floor assembly from being raised or bulged due to a heat expansion, and thereby increasing the lifetime of the wood floor assembly. Further, the wood floor assembly may provide the shock-absorbing, sound-proof, and ventilation effects.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A wood floor assembly, comprising wood floors, joint bases, soft pads, and U-shaped clips, wherein, the wood floor has a first elongated side protruded with an insertion flange, and a second elongated side recessed with an insertion groove, the insertion flange has a bottom edge recessed with a first insertion snap groove, the insertion groove has a bottom edge recessed with a second insertion snap groove, the wood floor has a bottom face formed with a securing groove;

the joint base is a hollow joint base made of plastic material, and has a first side protruded with an insertion block and a second side recessed with an insertion recess, the joint base has a top face having a central position that is protruded with a first locking plate and a second locking plate, the first locking plate of the joint base has a top edge having two sides extended with a first locking hook portion and a second locking hook portion;

the soft pad is a soft foamed pad that is bonded on a bottom face of the joint base; and the U-shaped clip is a metallic elastic snap clip structure, and is clamped and positioned two adjacent joint bases so that the two adjacent joint bases are integrally combined with each other.

2. The wood floor assembly in accordance with claim 1, wherein any two adjacent joint bases are inserted and assembled with each other, thereby forming an elongated rail-shaped floor fixing structure.

3. The wood floor assembly in accordance with claim 1, wherein the first locking hook portion of the joint base is snapped on the first insertion snap groove of the wood floor, and the second locking hook portion of the joint base is snapped on the second insertion snap groove of another wood floor.

4. The wood floor assembly in accordance with claim 1, wherein the second locking plate of the joint base has a top edge extended with a locking hook portion that is inserted and secured in the securing groove of the wood floor.

* * * * *